United States Patent [19]

Terazawa et al.

[11] 3,980,412

[45] Sept. 14, 1976

[54] CASING SEAL MEANS FOR A ROTARY PISTON ENGINE

[76] Inventors: Yasuto Terazawa, Kanyu-mubanchi, Kaita-cho; Fumio Imamaru, No. 2190, Kaitaichi, Kaita-cho, both of Aki, Hiroshima, Japan

[22] Filed: May 15, 1975

[21] Appl. No.: 577,623

Related U.S. Application Data

[63] Continuation of Ser. No. 390,341, Aug. 22, 1973, abandoned.

[30] Foreign Application Priority Data

Sept. 9, 1972 Japan ..... 47-105342

[52] U.S. Cl. ..... 418/149

[51] Int. Cl.[2] ..... F01C 19/00

[58] Field of Search ..... 418/61 A, 83, 149, 60; 277/22, 142, 188

[56] References Cited

UNITED STATES PATENTS

| | | | |
|---|---|---|---|
| 1,814,283 | 7/1931 | Braner | 277/22 |
| 3,103,366 | 9/1963 | Dunn | 277/188 R |
| 3,289,647 | 12/1966 | Turner et al. | 418/60 |
| 3,784,212 | 1/1974 | Doerfling | 277/22 |
| 3,809,509 | 5/1974 | Lamm | 418/60 |
| 3,844,694 | 10/1974 | Lamm | 418/149 |

FOREIGN PATENTS OR APPLICATIONS

| | | | |
|---|---|---|---|
| 2,017,769 | 10/1971 | Germany | 418/149 |
| 1,038,019 | 8/1966 | United Kingdom | 277/22 |

*Primary Examiner*—C. J. Husar
*Assistant Examiner*—Leonard Smith
*Attorney, Agent, or Firm*—Fleit & Jacobson

[57] ABSTRACT

In a rotary piston type engine including a casing comprising a rotor housing and a pair of side housings, a sealing member disposed between each of the side housing and the rotor housing for sealing combustion gas from working chambers and engine cooling liquid from coolant passage means in said housings, said sealing member comprising a rubber body and a heat resistant layer integrally moulded with the rubber body and disposed to face the working chamber so as to protect the rubber body against the heat of combustion gas.

2 Claims, 3 Drawing Figures

CASING SEAL MEANS FOR A ROTARY PISTON ENGINE

This is a continuation application of U.S. Ser. No. 390,341, filed Aug. 22, 1973, now abandoned.

This invention relates to a rotary piston type internal combustion engine, and more particularly to casing seal means therefor.

In a rotary piston type internal combustion engine comprising a casing including a rotor housing provided with a trochoidal inner periphery and a pair of side housings secured to the rotor housing, and a polygonal rotor disposed in said casing for planetary revolution and rotation so as to define working chambers of variable volume for effecting intake, compression, combustion, expansion and exhaust strokes, there are provided sealing means such as corner seals, side seals and oil seals mounted on the side surfaces of the rotor for maintaining a hermetical seal between the rotor and the side housings of the casing. In order that the seal means are maintained in sliding contact with the inner surfaces of the side housings providing the hermetical seal, it is necessary to have the side housings manufactured with a very high dimensional accuracy. Further, in an engine where cooling liquid passage means is provided through the side and rotor housings, it is also necessary to provide a positive water-tightness in order to prevent the cooling liquid from leaking into the working chamber.

Conventionally, in a casing of this type of rotary engine, the aforementioned requirements have been attained by mating the side and the rotor housings with O-ring seals interposed therebetween.

However, in the conventional arrangement, high temperature gas is admitted under high pressure into contact with the seal means through slight clearances which may possibly be present between the mated side and rotor housings. Thus, the O-ring seals are deteriorated or burnt to such an amount that the cooling liquid is allowed to enter through the seals into the working chamber causing serious problems in the engine.

Accordingly, it is an object of this invention to provide seal means for a rotary piston engine which eliminates the abovementioned defects.

It is another object of this invention to provide seal means for a rotary piston engine which is free from deterioration by hot combustion gas.

It is a further object of this invention to provide seal means which can positively prevent leakage of coolant into the working chamber.

In accordance with the present invention, the above objects can be achieved in a rotary piston type internal combustion engine comprising a casing having a rotor housing provided with a trochoidal inner peripheral wall surface and a pair of side housings secured to the opposite sides of the rotor housing, and a polygonal rotor disposed in said casing for planetary revolution and rotation so as to define working chambers between the casing and the rotor, circumferential cooling liquid passage means being provided throughout the thickness of the rotor housing and extending into at least a portion of each side housing, and sealing means being disposed between said rotor housing and each of the side housings at an area between the cooling liquid passage and the inner peripheral wall surface, the improvement comprises that said sealing means includes at least one seal member comprising a rubber body and a heat resistant layer integrally attached thereto so as to cover at least a portion of said body, said seal member being disposed with said heat resistant layer directed toward the working chambers.

The foregoing and other objects, features, and advantages of this invention will be apparent from the following descriptions of a preferred embodiment of the invention as illustrated in the accompanying drawings, in which.

Figure 1:
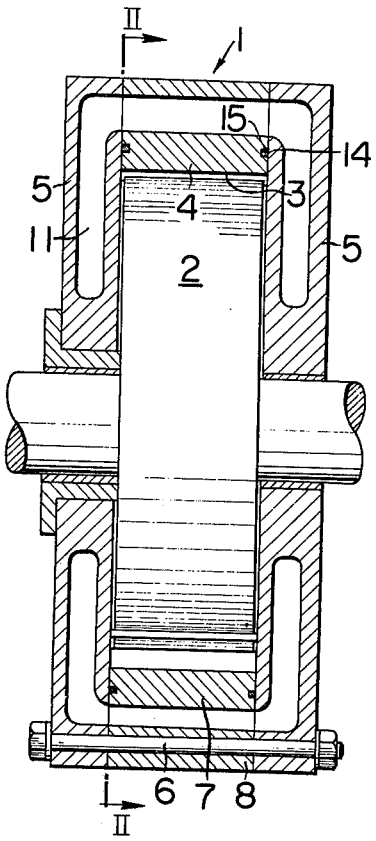
FIG. 1 is a longitudinal sectional view of a rotary piston engine equipped with a casing seal means according to this invention.
Figure 2:
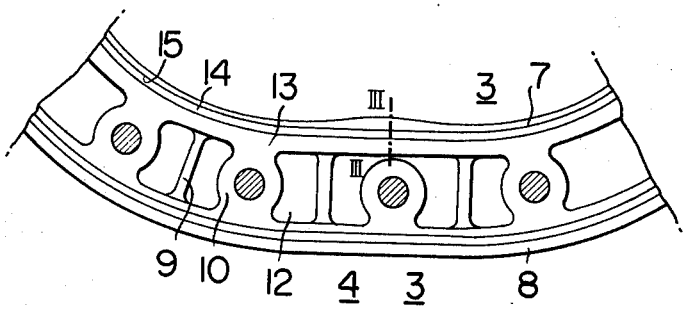
FIG. 2 is a fragmentary enlarged view taken along the line II—II in FIG. 1.

Referring to FIGS. 1 and 2, there is shown a rotary piston engine which comprises a casing 1 and a rotor 2 disposed in the casing 1 and carried on an eccentric shaft for planetary revolution and rotation in the casing 1. As is well known in the art, working chambers 3 are defined between the casing 1 and the rotor 2. As the rotor 2 rotates working fluid is taken into one of the working chambers 3 through an intake passage (not shown). Upon further rotation of the rotor 2, the volume of the working chamber 3 is decreased to compress the mixture therein. Thereafter, combustion, expansion and discharge strokes take place in the working chamber 3.

The casing 1 comprises a rotor housing 4 having a trochoidal inner peripheral wall surface and a pair of side housings 5 secured to the opposite sides of the rotor housing 4. Said rotor housing 4 and said side housings 5 are integrally secured together by means of a plurality of clamping bolts 6. The rotor housing 4 includes an inner wall 7 and an outer wall 8 which are integrally connected together with a predetermined radial spacing by means of ribs 9 and bolt bosses 10 to provide a cooling liquid passage 12. A cooling liquid passage 11 is provided in each of the side housings 5 and in communication with the passage 12 in the rotor housing 4. The rotor housing 4 is provided at each of the opposite side surfaces 13 of the inner wall portion 7 with a circumferential groove 15 for receiving a seal member 14. Alternatively, a circumferential groove 15 can be provided in each of the side housing 5 facing the rotor housing 4.

Figure 3:
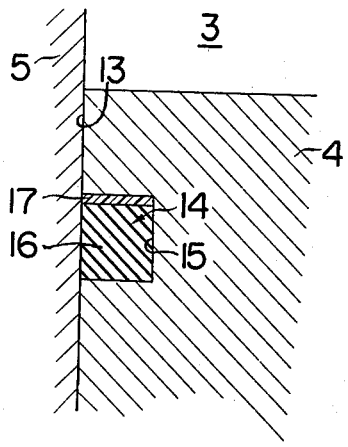
FIG. 3 is an enlarged side view taken along the line III—III in FIG. 2.

In accordance with the present invention, the seal member 14 includes, as shown in FIG. 3, a rubber body 16 and a heat resistant layer 17 made of Teflon (polytetrafluoroethylene), and covering a portions of the body 16. The body 16 and the heat resistant layer 17 is integrally moulded. The seal member 14 thus formed is disposed in the groove 15 with the heat resistant layer 17 facing the working chamber 3. When the side housing 5 is secured to the rotor housing 4, the rubber body 16 is placed in a sealing contact with the adjacent surface of the side housing 5. The cross-section of said seal member 14 may be either square or circular in shape. It should particularly be noted that the square cross-section is preferable from the economical viewpoint because such a sealing member can be produced from a hollow elongated cylindrical blank by merely slicing it.

Further, the heat resistant layer 17 is not limited only to heat resistant synthetic resin such as Teflon, but may also be made of metal such as copper, steel or the like that can protect the rubber body of the seal member against heat of the combustion gas from the working chamber.

As apparent from the foregoing descriptions, in accordance with the features of the present invention, hot combustion gas from the working chambers is effectively sealed by the heat resistant layer of the sealing member so that the rubber body can be protected against deterioration by the heat of the combustion gas. Further, since the heat resistant layer is integrally moulded with the rubber body, the sealing member can readily inserted into the sealing groove.

While the invention has been particularly shown and described with reference to preferred embodiments thereof, it will be understood by those skilled in the art that the foregoing and other changes in form and detail may be made therein without departing from the spirit and scope of the invention.

We claim:

1. In a rotary piston internal combustion engine including a casing having a rotor housing and a pair of side housings, said rotor housing having a trochoidal inner peripheral wall surface, said side housings mounted on opposed sides of said rotor housing, a polygonal rotor positioned in the space defined between said rotor housing and said side housings of said casing, said rotor being mounted for planetary revolution and rotation about an axis so as to define working chambers between the circumference of said casing and said rotor, circumferential cooling liquid passages extending axially through said rotor housing and into at least a portion of each of said side housings, and sealing means located between said rotor housing and each of said side housings and positioned between said cooling liquid passages and said inner peripheral wall surface of said rotor housing, the improvement in which each of said sealing means includes at least one seal member formed from a rubber body and a heat resistant layer integrally attached thereto and covering at least a portion of said rubber body, said seal member being positioned with said heat resistant layer interposed between said rubber body and said working chambers so as to protect said rubber body from the hot combustion gases in said working chambers, said heat resistant layer comprising polytetrafluoroethylene.

2. The rotary piston internal combustion engine of claim 1 in which either said rotor housing and each of said side housings has a circumferential groove in the surface facing the other housing, and said seal member is fitted in the groove.

* * * * *

UNITED STATES PATENT OFFICE

CERTIFICATE OF CORRECTION

PATENT NO. : 3,980,412

DATED : September 14, 1976

INVENTOR(S) : Yasuto Terazawa et al

It is certified that error appears in the above-identified patent and that said Letters Patent are hereby corrected as shown below:

On the title page, after the names and addresses of the inventors insert:

--Assignee: Toyo Kogyo Co., Ltd. Hiroshima-Ken, Japan; Nippon Oil Seal Industry, Co., Ltd. Tokyo, Japan --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*